US007849939B2

(12) United States Patent
Downton et al.

(10) Patent No.: US 7,849,939 B2
(45) Date of Patent: Dec. 14, 2010

(54) DRILL BIT

(75) Inventors: Geoffrey C. Downton, Sugar Land, TX (US); Richard Harmer, Surrey (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/187,948

(22) Filed: Aug. 7, 2008

(65) Prior Publication Data

US 2009/0065262 A1 Mar. 12, 2009

(30) Foreign Application Priority Data

Sep. 11, 2007 (GB) ..... 0717623.3

(51) Int. Cl.
*E21B 15/04* (2006.01)
*E21B 17/10* (2006.01)

(52) U.S. Cl. ..... 175/408; 175/73

(58) Field of Classification Search ..... 175/327, 175/331, 332, 334–336, 408, 420.2, 428, 175/393, 374, 426, 249, 430, 73
See application file for complete search history.

(56) References Cited

U.S. PATENT DOCUMENTS 1,667,155 A * 4/1928 Higdon ..... 175/263
7,318,492 B2 1/2008 Watson et al.
2002/0100618 A1 8/2002 Watson et al.

FOREIGN PATENT DOCUMENTS

WO 2007012858 2/2007

* cited by examiner

*Primary Examiner*—Jennifer H Gay
*Assistant Examiner*—Yong-Suk Ro
(74) *Attorney, Agent, or Firm*—Vincent Loccisano; Jeremy P. Welch; Brigitte L. Echols

(57) ABSTRACT

The present invention recites a drill bit comprising a main body having an axis about which it is rotated in use, a cutting face, a connecting means for attaching the bit to a source of rotary motion, a gauge region intermediate said cutting face and the connecting means. Additionally the gauge region comprises at least one member movable between a first position in which the gauge region is bounded by an imaginary tubular surface of constant cross-section co-axial to the axis of rotation and a second position in which a portion of the member is located radially inwards, with respect to the axis of rotation, of its position when said member is in said first position. In accordance with the present invention, the gauge region whilst said member is in said second position being bound by an imaginary three dimensional conical sectional surface; and at least one actuator.

19 Claims, 2 Drawing Sheets

DRILL BIT

BACKGROUND OF THE INVENTION

The invention herein described relates to a drill bit primarily for use in subterranean excavation.

In the following specification the term 'conical sectional surface' is deemed to mean a frustum of a generalised cone, the profile of the surface of which intermediate the base of the cone and its vertex may be straight, but may also be a generalised curve and may be continuous or discontinuous.

Conventional drill bits used in subterranean excavation are generally elongate structures with a generally circular cross-section comprising three main parts: First, there is a cutting face which contacts the material to be excavated. This usually comprises a plurality of cutting elements, the movement of which against the material to be cut causes matter to be cut or gouged away. Secondly, there are connecting means, usually located at an opposite end of the bit to the cutting face, for connecting the bit to a source of movement usually a rotary drill string. Thirdly, a so-called gauge region, intermediate the cutting face and connection means, the purpose of which is to contact sides of the hole being drilled in order to stabilise the movement of the bit. The gauge region may be generally free from cutting elements and has a diameter which is of similar size to that of the bore of the hole being drilled. The gauge region may also be provided with channels in its surface to allow cut material and drilling fluid to move away from the cutting face. This may occur as a result of drilling fluid being supplied to the cutting face by separate means, the drilling fluid displacing drilling fluid already present at the cutting face and cut material, causing it to flow through the gauge region channels away from the cutting face. The gauge region may be of generally uniform diameter, particularly if the drill bit is to be used in drilling straight holes. Gauge regions which incorporate a linear taper, i.e. where the diameter of the gauge region is reduced proportional to distance from the cutting face, resulting in a generally frusto-conical gauge region, have also been used.

It is well known to steer a drill bit so that it traces a curved path in a desired direction. In this situation part of the surface of the gauge region may be forced against the wall of the drill hole. This is a major problem, as it not only causes the drill bit to become unstable, but it also causes energy to be wasted in unnecessarily eroding the drill hole wall and/or the said surface of the gauge region. As the surface of the gauge region is also generally free of cutting elements, (but may have a hardened low-wear coating or covering) it means that its impacting with the drill hole wall will cause significant wear.

One method envisaged of overcoming this problem is the use of a drill bit with a curved profile gauge region. However, a drill bit of this type is less effective than a drill bit with a constant gauge cross section when utilised within a straight hole or a straight portion of a hole. This is due to the fact that curved profile of the gauge region will result in a portion of the gauge region not contacting the hole wall and therefore preventing it from stabilising the bit in the normal way.

Thus, a drill bit with a curved profile gauge region and a drill bit with a constant cross section gauge region are suitable for drilling either bent holes or straight holes respectively, but less effective in straight holes or bent holes respectively.

The proposed invention seeks to ameliorate the disadvantages hereinbefore described.

SUMMARY OF THE INVENTION

The present invention generally recites a drill bit suitable, in use, for producing a hole, wherein said drill bit comprises a main body having an axis about which it is rotated in use, a cutting face, the movement of which, in use, across the surface of the material to be cut causes material to be gouged or scraped away, a connecting means for, in use, attaching the bit to a source of rotary motion, said means also enabling the imparting of a force on the bit such that its cutting face is urged onto the material to be cut, a gauge region intermediate said cutting face and said connecting means, said gauge region comprising at least one member movable between a first position in which the gauge region is bounded by an imaginary tubular surface of constant cross-section co-axial to the axis of rotation; and a second position in which a portion of the member is located radially inwards, with respect to the axis of rotation, of its position when said member is in said first position, the gauge region whilst said member is in said second position being bound by an imaginary three dimensional conical sectional surface. Additionally, at least one actuator, each said member being mechanically linked to an actuator such that each member can be moved between said first and second positions by a said actuator is provided.

In accordance with the present invention, the actuator may be actuated by a control signal in response to the desired path of the drill bit such that said member occupies said first position whilst the drill bit traces a substantially straight path and said member occupies said second position whilst the drill bit traces a curved path. Additionally, the profile of said imaginary three dimensional conical sectional surface may be chosen so as to correspond to the curvature of the curved path the drill bit is tracing. Furthermore, the gauge region and in particular at least one movable member may be devoid of cutting elements and the cross section of the gauge region with respect to the axis of rotation may have a diameter equal or less than that of the cutting face. Additionally, at least one movable member, which may contact the drill hole wall in use, may incorporate at least one recess and said recess may be a generally axial channel to allow the passage of cut material away from the cutting face.

In accordance with the present invention, at least one member may be a plurality of fingers disposed upon the main body, said fingers extending parallel to the axis of rotation and being hinged at a first end to the main body and a hinge may be placed and orientated intermediate to the cutting face and an actuator mechanically linked to the finger. Additionally, one member may comprise a plurality of similar segments disposed upon said main body so as to form a gauge disc co-axial with the axis of rotation and there may be a plurality of gauge discs each comprising a plurality of movable segments, the gauge discs being spaced along the axis of rotation of the drill bit. Furthermore, the present invention may further comprise a means of permitting movement of the segments between first and second positions via a hinge connecting each segment to the main body and additionally wherein the movement of each segment between said first and second positions may be a radial rectilinear movement relative to the axis of rotation of the bit.

The present invention, as understood by one skilled in the art, may further comprise a plurality of actuators and members, each actuator being associated with a member, said actuators operating such that the members move between said first and said second positions in a uniform simultaneous manner. Additionally, the plurality of actuators and members, each actuator being associated with a member, said actuators operating such that the members may move between said first and said second positions in a sequential manner so as to effect a change in drilling direction of the bit. In accordance with one aspect, one actuator may be a ball screw actuator or may be a hydraulic actuator and is energised by a supply of drilling fluid. Furthermore, if a plurality of actuators are associated with the present invention, at least one actuator may be a ball screw actuator and at least one may be a hydraulic actuator. Furthermore, the present invention recites a control unit, said control unit regulating said at least one actuator and controlling movement of said at least one member between the first and second positions. Additionally, in accordance with the present invention a means of connecting the drill bit to pumping means located remote to the drill bit, wherein management of an output of said pumping means effecting control of the at least one actuator is recited.

DETAILED DESCRIPTION OF THE INVENTION

Figure 1:
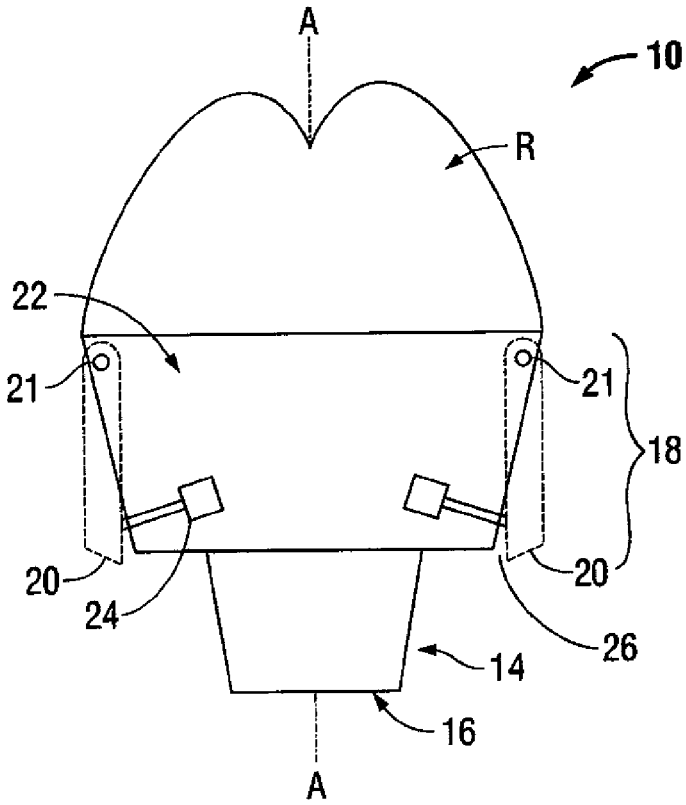
FIG. 1 shows a diagrammatic, side elevation, cross-sectional view of a first embodiment of the present invention.

According to the invention there is provided a drill bit suitable, in use, for producing a hole, comprising a main body having an axis about which it is rotated in use; a cutting face, the movement of which, in use, across the surface of the material to be cut causes material to be gouged or scraped away; connecting means for, in use, attaching the bit to a source of rotary motion, said means also enabling the imparting of a force on the bit such that its cutting face is urged onto the material to be cut; a gauge region intermediate said cutting face and said connecting means, said gauge region comprising at least one member movable between a first position in which the gauge region is bounded by an imaginary tubular surface of constant cross-section co-axial to the axis of rotation; and a second position in which a portion of the member is located radially inwards, with respect to the axis of rotation, of its position when said member is in said first position, the gauge region whilst said member is in said second position being bound by an imaginary three dimensional conical sectional surface; and at least one actuator, each said member being mechanically linked to an actuator such that each member can be moved between said first and second positions by a said actuator.

Desirably, said actuator is actuated by a control signal in response to the desired path of the drill bit such that said member occupies said first position whilst the drill bit traces a substantially straight path and said member occupies said second position whilst the drill bit traces a curved path.

Preferably, the profile of said imaginary three-dimensional conical sectional surface is chosen so as to correspond to the curvature of the curved path the drill bit is tracing.

Desirably, the gauge region and in particular at least one movable member is devoid of cutting elements.

Preferably, the cross section of the gauge region with respect to the axis of rotation has a diameter equal to or less than that of the cutting face.

Desirably, said at least one movable member, which may contact the drill hole wall in use, incorporates at least one recess.

Advantageously, said at least one recess is a generally axial channel to allow the passage of cut material away from the cutting face. This prevents the cutting face from becoming clogged with cut material.

Desirably, said at least one member comprises a plurality of fingers disposed upon the main body, said fingers extending parallel to the axis of rotation and being hinged at a first end to the main body.

Preferably, said hinge is disposed intermediate the cutting face and an actuator mechanically linked to the finger.

Desirably, said at least one member comprises a plurality of similar segments disposed upon said main body so as to form a gauge disc co-axial with the axis of rotation.

Advantageously, there is a plurality of gauge discs each comprising a plurality of movable segments, the gauge discs being spaced along the axis of rotation of the drill bit.

Desirably, the means of permitting movement of said segments between first and second positions is a hinge connecting each segment to the main body.

Advantageously, the movement of each segment between said first and second positions is a radial rectilinear movement relative to the axis of rotation of the bit.

Preferably, there are a plurality of actuators and members, each actuator being associated with a member, said actuators operating such that the members move between said first and said second positions in a uniform simultaneous manner.

Advantageously, there are a plurality of actuators and members, each actuator being associated with a member, said actuators operating such that the members move between said first and said second positions in a sequential manner so as to effect a change in drilling direction of the bit.

Desirably, said at least one actuator is a ball screw actuator.

Advantageously, said at least one actuator is a hydraulic actuator and is energised by a supply of drilling fluid.

Advantageously, there are a plurality of actuators, at least one being a ball screw actuator and at least one being a hydraulic actuator.

Preferably, said drill bit additionally comprises a control unit, said control unit regulating said at least one actuator and controlling movement of said at least one member between the first and second positions.

Desirably, said drill bit additionally comprises means of connecting the drill bit to pumping means located remote to the drill bit, management of an output of said pumping means effecting control of the at least one actuator.

Embodiments of the invention will now be described, by way of example, with reference to the accompanying drawings, in which:

As seen best in FIG. 1 a drill bit, indicated generally as 10, comprises a cutting face 12 having cutters (not shown), the movement of which, in use, across the surface of the material to be cut causes material to be gouged or scraped away. A motor (not shown) rotates the bit about an axis A-A via a shaft or drill string (also not shown) which is coupled to connection region 14 of the bit by connecting means 16. The shaft (not shown) also imparts a force on the bit, urging the cutting face 12 on to the material to be cut. Intermediate the cutting face 12 and the connection region 14 is a gauge region 18. In use, the gauge region 18 can occasionally contact the side of the drill hole cut by the cutting face 12 and hence provides limit of movement stability for the bit in operation. The gauge region 18 is generally circular in cross section and its surface is usually of less hard material than the cutting face 12, and as such be prone to wear.

Two kinds of gauge 18 region commonly used in current drill bits 10 include; a gauge region cylindrical about the axis of rotation A-A, of similar diameter to that of the cutting face 12, which is particularly suited to use in applications where it is desired to drill a straight hole; or, for use in steered drilling, where the path of the drill bit is curved, a tapered gauge region 18 where its diameter varies in relation to the distance along the axis of rotation A-A from the cutting face 12. The profile of such a tapered gauge region 18 may be straight and at an angle to the axis of rotation A-A or may be curved. It is common that the diameter of a tapered gauge region 18 decreases as a function of distance from the cutting face 12.

A cylindrical gauge region 18 is desirable for straight drilling as it provides the greatest contact between gauge region 18 and the wall of the hole being drilled. This results in the utmost possible stability of the bit 10 as it rotates in use. A tapered gauge region 18 is preferable for steered drilling as if a cylindrical gauge region 18 were incorporated into a steerable drilling system, then as the bit 10 executes curved paths, a portion of the gauge region 18 may be forced into the drill hole wall. Not only will this cause a waste of energy due to unnecessary friction, but it may also destabilise the bit, causing it to veer. As the gauge region 18 is worn if it is urged into the material which is being cut with any significant force, substantial wear will also occur in these situations, which may result in the bit becoming unusable, well before the cutting face 12 is worn out.

The profile of a tapered gauge region 18 is such that as the bit executes a curved path the gauge region 18 is not urged into the hole wall and as such the bit 10 is not restricted from rotating. However, light contact is still made between the hole wall and the gauge region 18 enabling stabilisation of the bit 10 as it rotates in use. Through a combination of preventing the gauge region 18 from being urged into the hole wall whilst enabling light contact between the hole wall and the gauge region 18, a tapered gauge region results in an increase in steering efficiency whilst drilling curved paths and a reduction in bit 10 generated vibrations. If a tapered gauge bit 10 were to be used in straight drilling it would be at a distinct disadvantage as a large portion of the gauge region 18 would not contact the hole wall and therefore not be able to stabilise the bit 10, as it rotates, in the normal manner.

Whilst drilling a hole it may be necessary to drill a combination of straight and curved sections. At present, if this is the case, either only one type of gauge bit 10 is used, it being suited to either straight or curved drilling and hence being inefficient at the other; or a different drill bit 10 must be used for each section. Swapping the drill bit 10 is a very labour intensive and time consuming process as drilling must be stopped, the drill string must be withdrawn, the bit 10 swapped and the drill string re-inserted into the hole before drilling may continue.

In order to overcome these disadvantages the current invention enables the gauge region 18 of the bit 10 to be changed between a cylindrical gauge region and a tapered gauge region whilst the drill bit 10 is in use. This results in improved drill hole, or wellbore, quality in straight sections without the expense of reduced steering response.

The ability to change between a cylindrical gauge region and a tapered gauge region whilst the drill bit 10 is in use also reduces the risk of the bit 10 sticking within the hole when used in an application such as using impregnated bits, which are typically very long gauge bits run at high speeds by turbines in excess of 500 rpm.

In a first embodiment of the present invention, shown in FIG. 1, the means by which the gauge region 18 profile is changed is by the use of a plurality of fingers 20 being spaced from one another around the circumference of the bit 10. Each finger 20 is hinged 21 at a first end to an inner portion 22 of the gauge region 18 adjacent to the cutting face 12. An actuator 24 is mechanically linked to a second opposite end of each finger 20. When the actuators 24 are in a first state (not shown) the finger 20 sits flush against the inner portion 22 of the gauge region 18. The finger 20 may also be received in a recess (not shown) in the inner portion 22, when it is in the first state. As such a bit 10 with a plurality of identical fingers 20 spaced circumferentially around the inner portion 22, each linked to an actuator 24 in said first state, will have a tapered gauge region, bounded by an imaginary conical sectional surface with a profile indicated by 26. Hence with the actuators 24 in the first state, the bit 10 will have a tapered gauge region suitable for steered drilling. If it is desirable to drill in a straight line the actuators 24 are energised and moved to the second state. When the actuator 24 moves to said second state from said first state, the attached finger 20 pivots around the hinge 21, a portion of the finger 20 moving to a greater radial distance relative to A-A so that the finger 20 occupies a position in which the surface of the finger 20 radially most distant from the axis of rotation A-A lies parallel to the axis of rotation A-A at a radial distance from A-A similar to the radius of the cutting face (shown as dotted lines in FIG. 1). In this manner several identical fingers 20 spaced circumferentially around the bit 10 actuated in the same manner will give rise to a gauge region 18 bounded by an imaginary cylindrical surface co-axial to A-A. To change the bit 10 so that it can drill a curved path having drilled a straight path the actuators 24 are energised so that they move form there second state to there first state.

Figure 2:
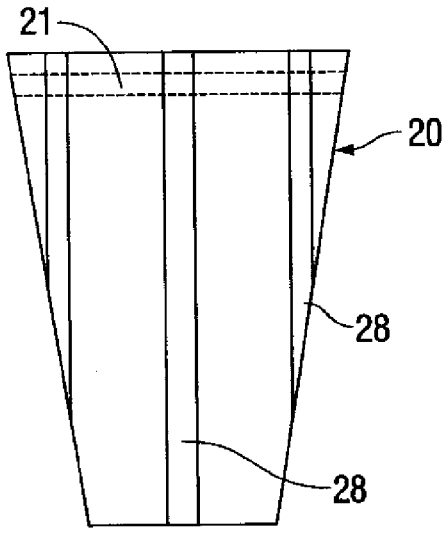
FIG. 2 shows a diagrammatic, side elevation view of a finger component of the first embodiment of the invention.
Figure 3:
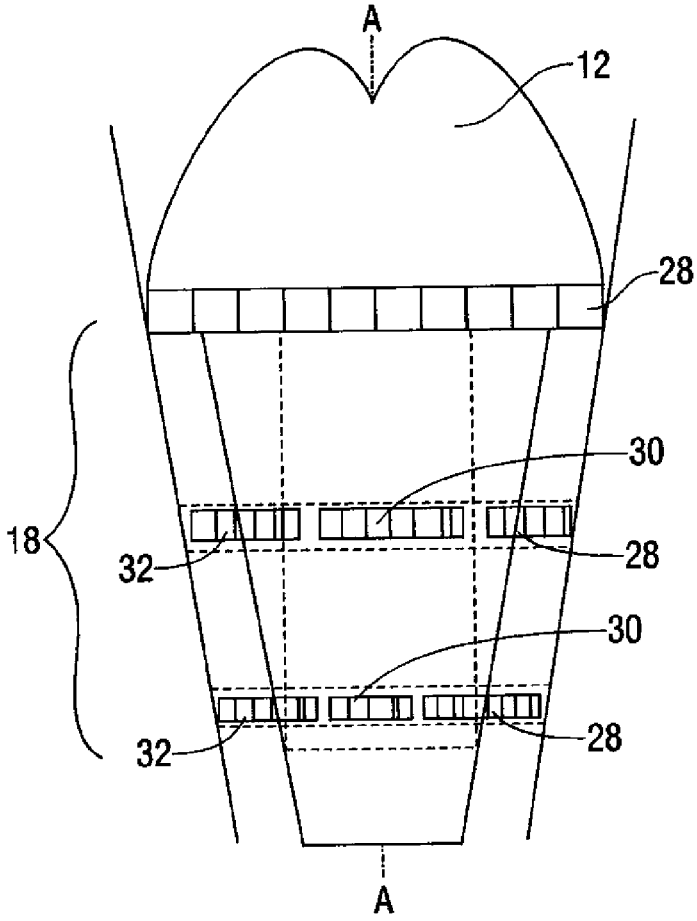
FIG. 3 shows a diagrammatic, side elevation view of a second embodiment of the present invention.

Each finger 20, shown clearly in FIG. 2, comprises a plurality of generally axially disposed channels 28 which aid the passage, between the gauge surface and drill hole wall, of cuttings away from the cutting edge. The channels 42 may be uniform in cross-section and axial as shown, but may also be of non-uniform cross-section and/or trace a non-axial path across said gauge region surfaces (not shown).

Each finger 20 may be planar or curved and is generally shaped as a trapezium, with a greater width at the hinge 21 end compared to the end opposite the hinge 21. This is to enable the end opposite the hinge 21 of each finger 20 to sit adjacent one another at the reduced radial distance whilst the actuators are in said first state. If the finger 20 is curved, it may be curved in any direction, but preferably it is curved co-axially to the axis A-A as this minimises the contact of any edges of the finger with the hole wall on rotation of the bit 10.

Figure 4:
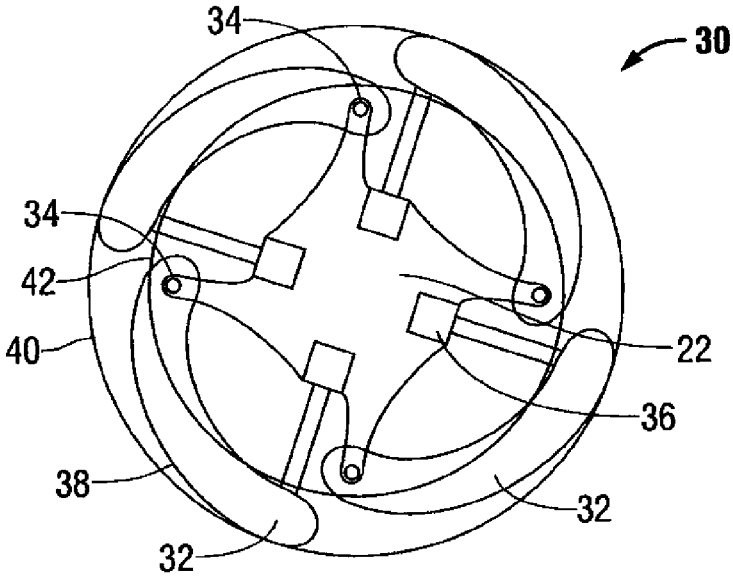
FIG. 4 shows a diagrammatic, top elevation, cross sectional view of the second embodiment of the present invention.

In a separate embodiment of the present invention the gauge region 18 comprises a plurality of gauge discs 30 spaced along the axis of rotation A-A. As seen best in FIG. 4 each gauge disc 30 comprises a plurality of similar movable segments 32. Each segment is hinged 34 at a first end to the inner portion 22 of the gauge region 18. An actuator 36 links a second end of each segment 32 to the inner portion 22. In a first state, as shown in FIG. 4, each actuator 36 holds each segment 32 so that the radially outermost surface 38 of each segment 32 is bounded by an imaginary circle 40. If the actuators 36 are energised so that they are in a second state (not shown) then the segments 32 pivot about hinges 34 and a portion of each segment 32 moves radially inward with respect to the position of the segments 32 whilst the actuators 36 are in their first state. Whilst the actuators 36 are in their second state the radially outermost surface 38 of each segment 32 is bounded by an imaginary circle 42 of radius less than that of the other imaginary circle 40. In this way the diameter of each gauge disc 30 can be varied.

As the gauge discs 30 are spaced along the axis A-A of the bit 10, then by altering the diameters of the discs it is possible to change the profile of the gauge region 18 parallel to the axis A-A. For example, the segments 32 of each disc 30 may be positioned by their respective actuators 36 such that the radially outermost surface 38 of each segment 32 of each disc 30 is bounded by an imaginary circle 40 of the same radius as the radius of the cutting face 12. In this way the gauge region 18 is bounded by an imaginary cylindrical surface, the drill bit 10 in this configuration being suitable for drilling straight hole sections.

In a different mode of operation of the bit 10 the segments 32 of each disc 30 are positioned by their respective actuators 36 such that the radially outermost surface 38 of each segment 32 of a first disc 30 is bounded by an imaginary circle 40 of lesser radius than the imaginary circle 40 bounding the radially outermost surface 38 of each segment 32 of a second disc 30 situated intermediate the cutting face 12 and first disc 30. In this mode of operation the gauge discs 30 are bounded by an imaginary conical sectional surface which is tapered and as such the bit 10 in this configuration is suitable for steered drilling, i.e. the drilling of curved hole sections.

Using either embodiment, the profile of the gauge region 18 parallel to the axis A-A may be chosen such that it matches the intended curvature of the drill hole resulting from a change in drilling direction whilst utilising the drill bit as part of a directional drilling system. Such a bit will be particularly efficient at drilling holes of said curvature.

In order to create a particular profile of gauge region 18 parallel to axis A-A the position of each actuator 24, 36 must be co-ordinated. Such co-ordination is provided by a control unit (not shown) which may be part of the bit 10 or located remote to it.

It is also envisaged that the actuators 24, 36 could be operated in a non-uniform or sequential way so as to impart a force in a specific direction to the hole wall as the drill bit rotates. This would allow steering of the drill bit 10 by the movable gauge region 18 members 20, 32. Again, the co-ordination of the actuators 24, 36 may be provided by a control unit which operates as a function of the steering response required and is either part of the bit 10 or remote to it.

The actuators 24, 36 may be of any type, but particular examples which are envisaged are ball screw type actuators and hydraulic actuators. The hydraulic actuators may be energised by drilling fluid or mud which is pumped to the bit 10.

The actuators 24, 36 may also be connected to pumping means (not shown) located remote to the drill bit 12, management of an output of said pumping means effecting control of the actuators. This output management may include cycling the pumping means, whereby the pumping means is turned on and off repetitively, each cycle being responsible for selecting one of a plurality of sequential actuator 24, 36 states. I.e. each cycle of the pumping means selects the next actuator state in the sequence.

It will be appreciated that a number of modifications can be made to the device within the scope of the invention. Examples of such modifications include, but are not limited to, the use of a different number of gauge discs (including just one), the use of a different shaped inner portion of the gauge region, the use of a different cutting face structure, integrating the shaft connection means into the gauge region, the use of different means for connecting the bit to the drive shaft; and the use of actuators which are the only means of connecting the movable gauge region members to the bit, said actuators moving radially relative to the axis A-A in a rectilinear manner.

What is claimed is:

1. A drill bit suitable, in use, for producing a hole, comprising:

a main body having an axis about which it is rotated in use, a cutting face, the movement of which, in use, across the surface of the material to be cut causes material to be gouged or scraped away, a connecting mechanism for, in use, attaching the bit to a source of rotary motion, said connecting mechanism also enabling the imparting of a force on the bit such that its cutting face is urged onto the material to be cut, a gauge region intermediate said cutting face and said connecting means, said gauge region comprising at least one member movable between a first position in which the gauge region is bounded by a hypothetical tubular surface of constant cross-section co-axial to the axis of rotation; and a second position in which a portion of the member is located radially inwards, with respect to the axis of rotation, of its position when said member is in said first position, the gauge region whilst said member is in said second position being bound by a hypothetical three dimensional conical sectional surface;

at least one actuator, each said member being mechanically linked to an actuator such that each member can be moved between said first and second positions by a said actuator; wherein said actuator is actuated by a control signal in response to the desired path of the drill bit such that said member occupies said first position whilst the drill bit traces a substantially straight path and said member occupies said second position whilst the drill bit traces a curved path.

2. A drill bit as claimed in claim 1 wherein the profile of said hypothetical three dimensional conical sectional surface is chosen so as to correspond to the curvature of the curved path the drill bit is tracing.

3. A drill bit as claimed in claim 1 wherein the gauge region and in particular at least one movable member is devoid of cutting elements.

4. A drill bit as claimed in claim 1 wherein the cross section of the gauge region with respect to the axis of rotation has a diameter equal or less than that of the cutting face.

5. A drill bit as claimed in claim 1 wherein said at least one movable member, which may contact the drill hole wall in use, incorporates at least one recess.

6. A drill bit as claimed in claim 5 wherein said at least one recess is a generally axial channel to allow the passage of cut material away from the cutting face.

7. A drill bit as claimed in claim 1 wherein said at least one member is a plurality of fingers disposed upon the main body, said fingers extending parallel to the axis of rotation and being hinged at a first end to the main body.

8. A drill bit as claimed in claim 7 wherein said hinge is intermediate the cutting face and an actuator mechanically linked to the finger.

9. A drill bit as claimed in claim 1 wherein said at least one member comprises a plurality of similar segments disposed upon said main body so as to form a gauge disc co-axial with the axis of rotation.

10. A drill bit as claimed in claim 9 wherein there is a plurality of gauge discs each comprising a plurality of movable segments, the gauge discs being spaced along the axis of rotation of the drill bit.

11. A drill bit as claimed in claim 9 wherein a hinge connects each segment to the main body.

12. A drill bit as claimed in either claim 9 wherein the movement of each segment between said first and second positions is a radial rectilinear movement relative to the axis of rotation of the bit.

13. A drill bit as claimed in claim 1 wherein there are a plurality of actuators and members, each actuator being associated with a member, said actuators operating such that the members move between said first and said second positions in a uniform simultaneous manner.

14. A drill bit as claimed in claim 1 wherein there are a plurality of actuators and members, each actuator being associated with a member, said actuators operating such that the members move between said first and said second positions in a sequential manner so as to effect a change in drilling direction of the bit.

15. A drill bit as claimed in claim 1 wherein said at least one actuator is a ball screw actuator.

16. A drill bit as claimed in claim 1 wherein said at least one actuator is a hydraulic actuator and is energised by a supply of drilling fluid.

17. A drill bit as claimed in claim 1 wherein there are a plurality of actuators, at least one being a ball screw actuator and at least one being a hydraulic actuator.

18. A drill bit as claimed in claim 1 additionally comprising a control unit, said control unit regulating said at least one actuator and controlling movement of said at least one member between the first and second positions.

19. A drill bit as claimed in claim 1 any additionally comprising means of connecting the drill bit to pumping means located remote to the drill bit, management of an output of said pumping means effecting control of the at least one actuator.

* * * * *